US007887470B2

(12) United States Patent
Chen

(10) Patent No.: US 7,887,470 B2
(45) Date of Patent: Feb. 15, 2011

(54) MULTI PURPOSE EXERCISER

(76) Inventor: I-Huang Chen, No. 66, Alley 71, Lane 252, Sec. 2, Jieshou Rd., Pateh City, Taoyuan Hsien (TW)

( * ) Notice: Subject to any disclaimer, the term of this patent is extended or adjusted under 35 U.S.C. 154(b) by 59 days.

(21) Appl. No.: 12/384,526

(22) Filed: Apr. 6, 2009

(65) Prior Publication Data

US 2010/0255965 A1 Oct. 7, 2010

(51) Int. Cl.
*A63B 21/00* (2006.01)

(52) U.S. Cl. ..... 482/138; 482/130; 482/133

(58) Field of Classification Search ..... 482/99–103, 482/120–130, 133–139, 142, 908; D21/676; 273/109, 110
See application file for complete search history.

(56) References Cited

U.S. PATENT DOCUMENTS 4,791,916 A * 12/1988 Paez ..... 602/26
5,362,296 A * 11/1994 Wang et al. ..... 482/133
6,599,223 B2 * 7/2003 Wang et al. ..... 482/138
6,652,426 B2 * 11/2003 Carter et al. ..... 482/100
2005/0101455 A1 * 5/2005 Chen ..... 482/121
2008/0051256 A1 * 2/2008 Ashby et al. ..... 482/5
2008/0096735 A1 * 4/2008 Grider ..... 482/99

FOREIGN PATENT DOCUMENTS

DE 3901578 A1 * 8/1990
FR 2581550 A1 * 11/1986

* cited by examiner

*Primary Examiner*—Loan Thanh
*Assistant Examiner*—Daniel F Roland
(74) *Attorney, Agent, or Firm*—William E. Pelton, Esq.; Cooper & Dunham LLP

(57) ABSTRACT

A multi-purpose exerciser has a main frame, two extending assemblies being mounted pivotally on the main frame and engaging each other and a lock assembly selectively holding the extending assemblies at specific angles. According to the angles of the extending assemblies and different exercising poses an exerciser performs, different body parts are trained.

19 Claims, 15 Drawing Sheets

MULTI PURPOSE EXERCISER

BACKGROUND OF THE INVENTION

1. Field of the Invention

The present invention relates to an exerciser, especially to a multi-purpose exerciser that allows different exercising poses to be performed to train different body parts.

2. Description of the Prior Arts

Busy people do not have enough time to exercise outdoors. Therefore, various conventional exercisers are developed to allow people to exercise indoors and to maintain their health.

However, conventional exercisers are large and specific devices exercise different parts of a body. Thus, in order to attain all-round exercise, people should buy many different conventional exercisers, which requires large investment and occupies much room.

To overcome the shortcomings, the present invention provides a multi-purpose exerciser to mitigate or obviate the aforementioned problems.

SUMMARY OF THE INVENTION

The main objective of the present invention is to provide a multi-purpose exerciser. The multi-purpose exerciser has a main frame, two extending assemblies being mounted pivotally on the main frame and engaging each other and a lock assembly selectively holding the extending assemblies at specific angles. According to the angles of the extending assemblies and different exercising poses an exerciser performs, different body parts are trained.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
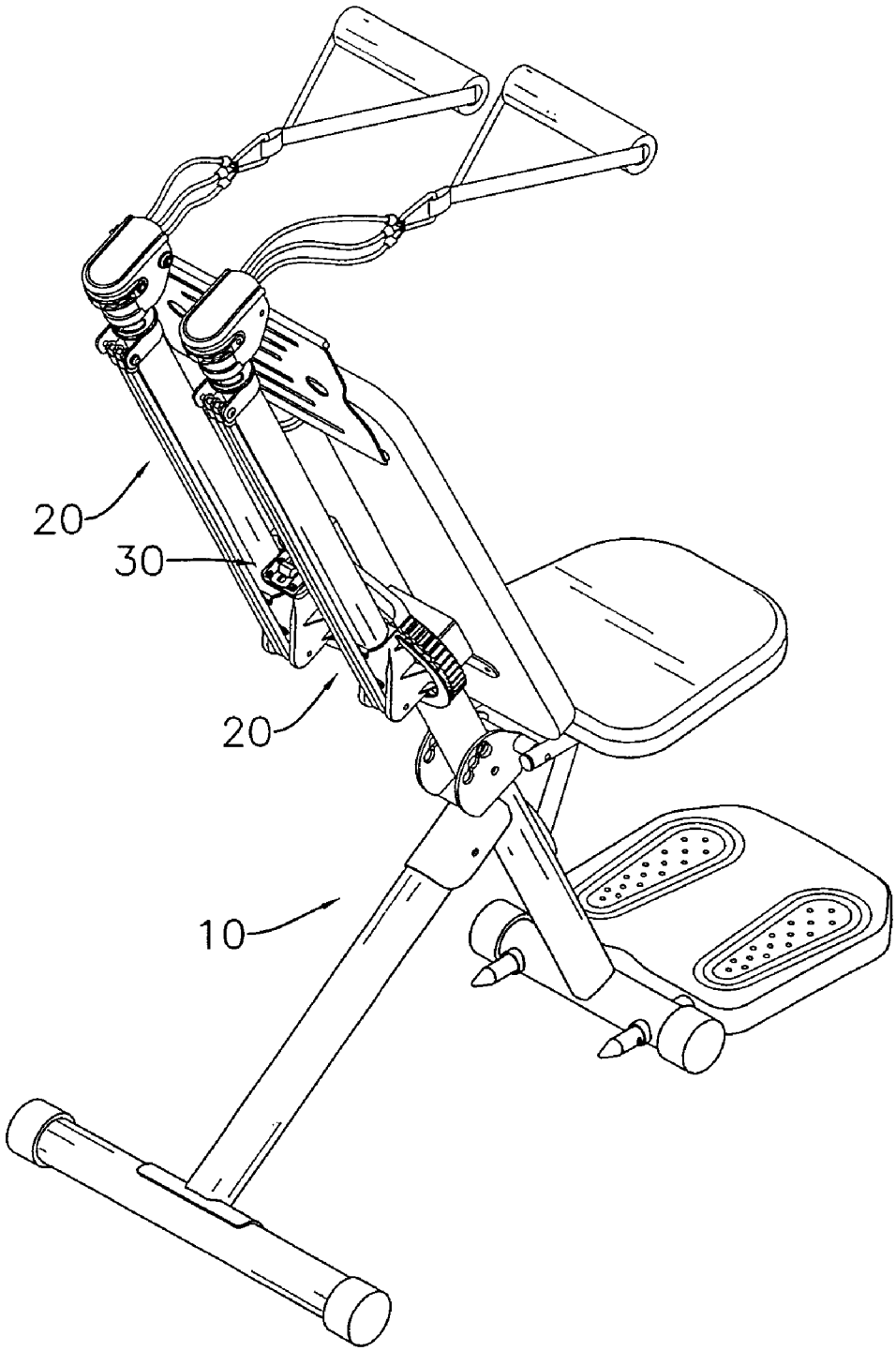
FIG. 1 is a perspective view of a multi-purpose exerciser in accordance with the present invention.

With reference to FIG. 1, a multi-purpose exerciser in accordance with the present invention comprises a main frame (10), two extending assemblies (20) and a lock assembly (30).

Figure 2:
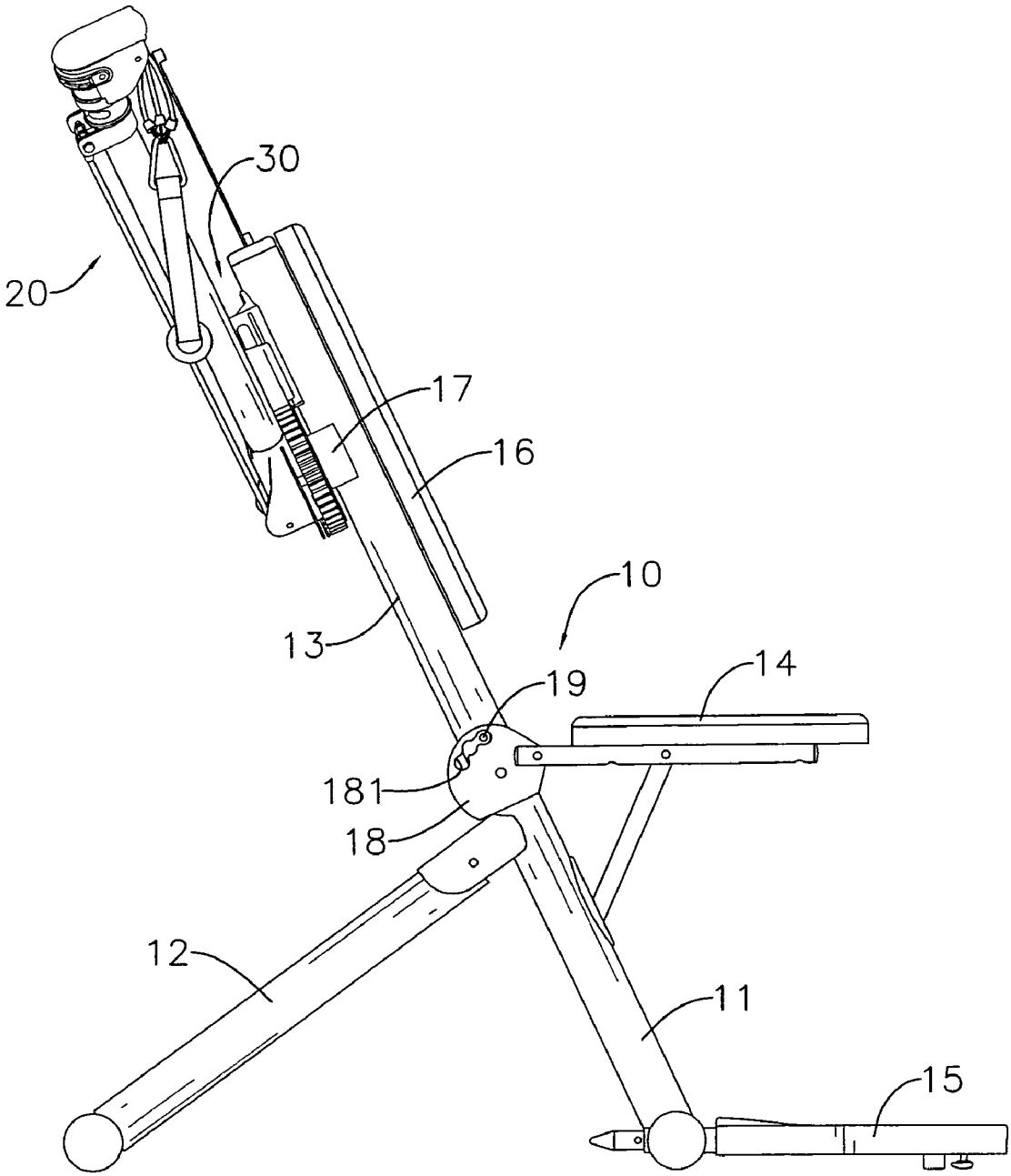
FIG. 2 is a side view of the multi-purpose exerciser in FIG. 1.
Figure 3:
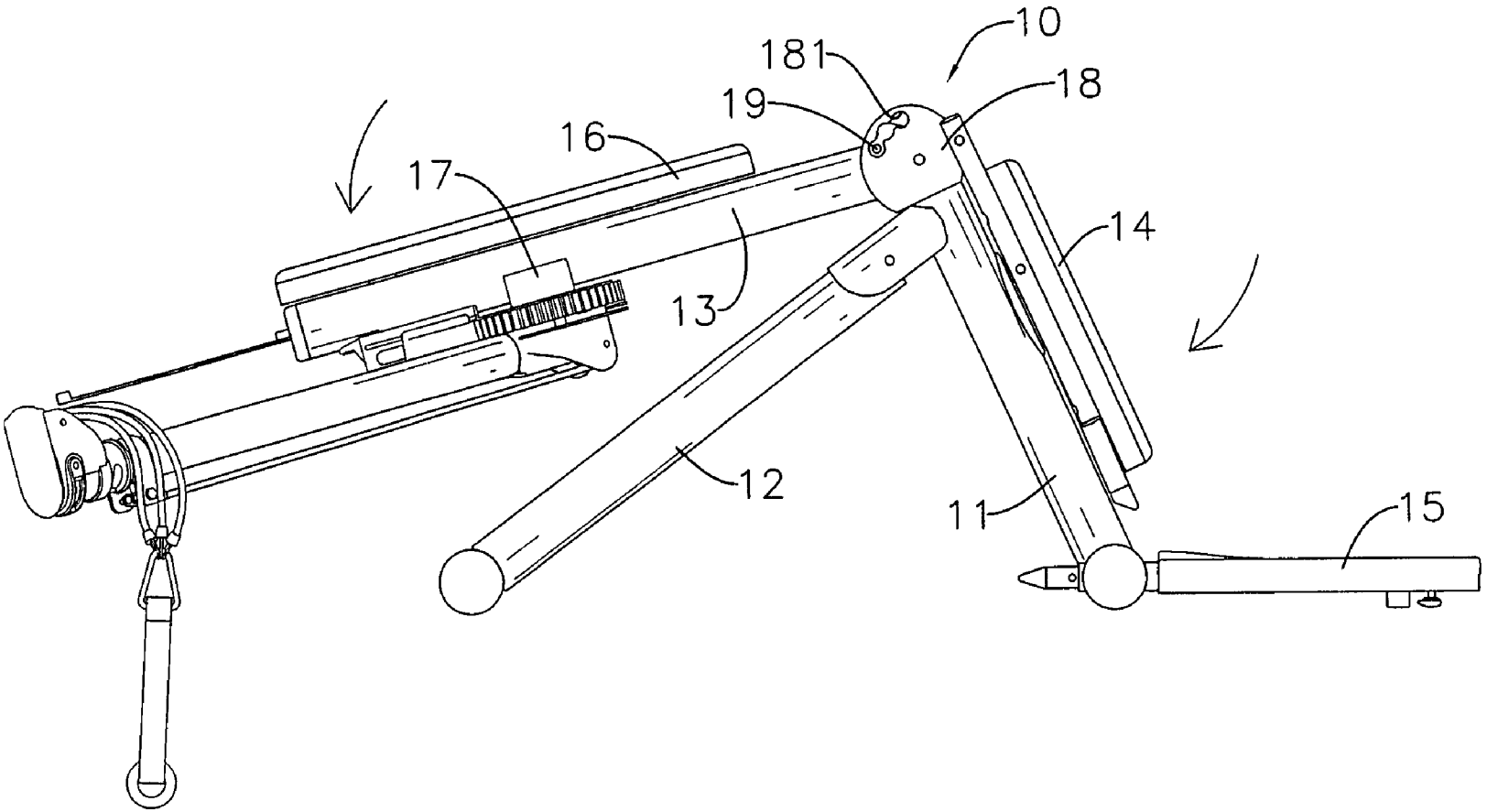
FIG. 3 is an operational side view of the multi-purpose exerciser in FIG. 1, showing a main support of a main frame being held in a specific angle.

With further reference to FIGS. 2 and 3, the main frame (10) may have a base (11), a side support (12), an adjusting bracket (18), a main support (13), a rod (19), a seat cushion (14), a footrest (15), a back cushion (16) and a gear mount (17).

The base (11) is adapted to a surface and has an upper end and a lower end. The side support (12) stands on the surface and is connected to and supports the base (11).

The adjusting bracket (18) is mounted on the upper end of the base (11) and has two opposite sidewalls and multiple mounting holes (181). The mounting holes (181) are separately formed through the sidewalls of the adjusting bracket (18). Two corresponding mounting holes (181) are respectively formed on the opposite sidewalls of the adjusting bracket (18) and are aligned with each other.

The main support (13) is mounted on the upper end of the base (11), may be mounted on the adjusting bracket (18) and protrudes upwardly.

The rod (19) is mounted through the corresponding mounting holes (181) of the adjusting bracket (18) and the main support (13) to hold the main support (13) in a specific position. Thus, the main support (13) is held at different angles when the rod (19) is mounted in different mounting holes (181) of the adjusting bracket (18).

The seat cushion (14) is connected pivotally to the base (11), adjacent to the upper end of the base (11). The footrest (15) is mounted on the base (11) adjacent to the lower end of the base (11), is placed on the surface and corresponds to the seat cushion (14). The back cushion (16) is mounted on the main support (13). Therefore, an exerciser can sit on the seat cushion (14) with feet placed on the footrest (15) and back leaning on the back cushion (16).

The gear mount (17) is mounted securely on the main support (13) opposite to the back cushion (16).

Figure 4:
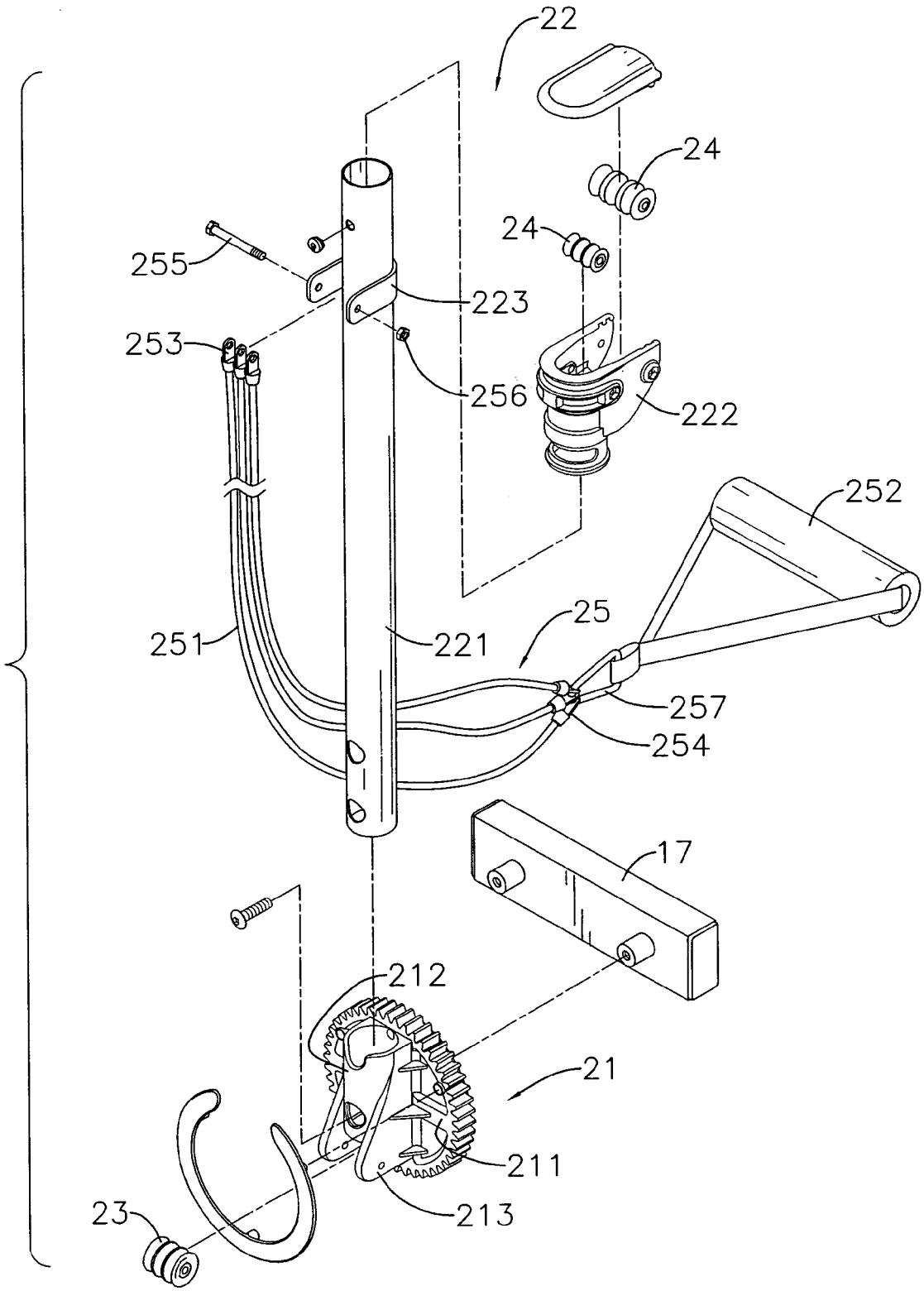
FIG. 4 is an exploded perspective view of an extending assembly of the multi-purpose exerciser in FIG. 1.

With further reference to FIG. 4, the extending assemblies (20) are mounted pivotally on the main frame (10), and may be mounted pivotally on the gear mount (17) of the main frame (10). Each extending assembly (20) has a gear (21), a mounting panel (211), an optional mounting tube (212), two optional lower wings (213), an elongated bracket (22), a lower roller set (23), an upper roller set (24) and a rope set (25).

The gear (21) is mounted pivotally on the main frame (10), may be mounted pivotally on the gear mount (17) of the main frame (10). The gears (21) of the extending assemblies (20) engage each other. The mounting panel (211) is attached securely to the gear (21). The mounting tube (212) is attached to the mounting panel (211) and has an outer surface. The lower wings (213) protrude tangentially from the outer surface of the mounting tube (212) and correspond to each other.

The elongated bracket (22) is connected to the mounting panel (211) and has an extending tube (221) and may have a roller mount (222). The extending tube (221) is mounted radially and securely on the mounting panel (211), has a proximal open end, a distal open end and an outer surface and may have two upper wings (223). The proximal open end of the extending tube (221) may be mounted securely in the mounting tube (212). The upper wings (223) protrude tangentially from the outer surface of the extending tube (221) and correspond to each other. The roller mount (222) is mounted around the distal open end of the extending tube (221) and communicates with the extending tube (221).

The lower roller set (23) is mounted rotatably in the mounting tube (212), may be mounted between the lower wings (213) and has at least one roller.

The upper roller set (24) is mounted rotatably in the roller mount (222) and has at least one roller.

Figure 5:
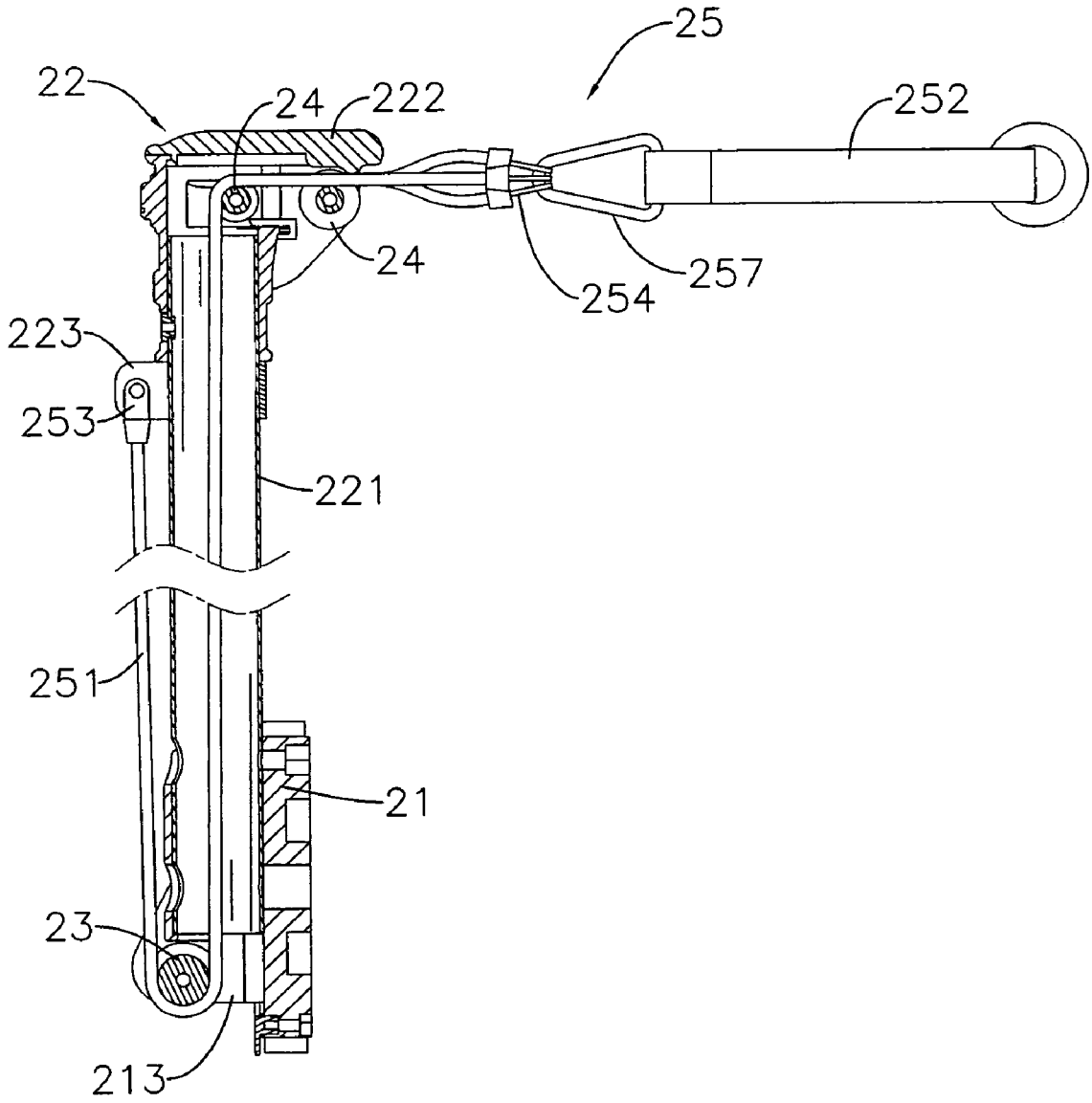
FIG. 5 is a side view in partial section of the extending assembly of the multi-purpose exerciser in FIG. 1.

With further reference to FIG. 5, the rope set (25) is connected to the elongated bracket (22) and has at least one rope (251), an optional connecting ring (257), a handle (252), an optional bolt (255) and an optional fastener (256).

The at least one rope (251) is extensible, is mounted longitudinally through the extending tube (221) of the elongated bracket (22) and may be mounted across the roller sets (23, 24). Each of the at least one rope (251) has a fastening end and an extending end and may have two connecting leaves (253, 254). The fastening end of the at least one rope (251) corresponds to the proximal open end of the extending tube (221) of the elongated bracket (22) and is attached to the extending tube (221) of the elongated bracket (22). The extending end of the at least one rope (251) corresponds to and extends out from the distal open end of the extending tube (221) of the elongated bracket (22) and may extend out from the roller mount (222) of the elongated bracket (22). The connecting leaves (253, 254) are attached respectively and securely to the fastening end and the extending end of the at least one rope (251).

The connecting ring (257) is connected to the connecting leaf (254) in the extending end of the at least one rope (251).

The handle (252) is connected to the extending end of the at least one rope (251) and may be connected to the connecting ring (257).

The bolt (255) is mounted through the upper wings (223) of the elongated bracket (22) and the connecting leaf (253) of the at least one rope (251) and has an end. The fastener (256) is fastened to the end of the bolt (255) to secure the fastening end of the at least one rope (251).

Figure 6:
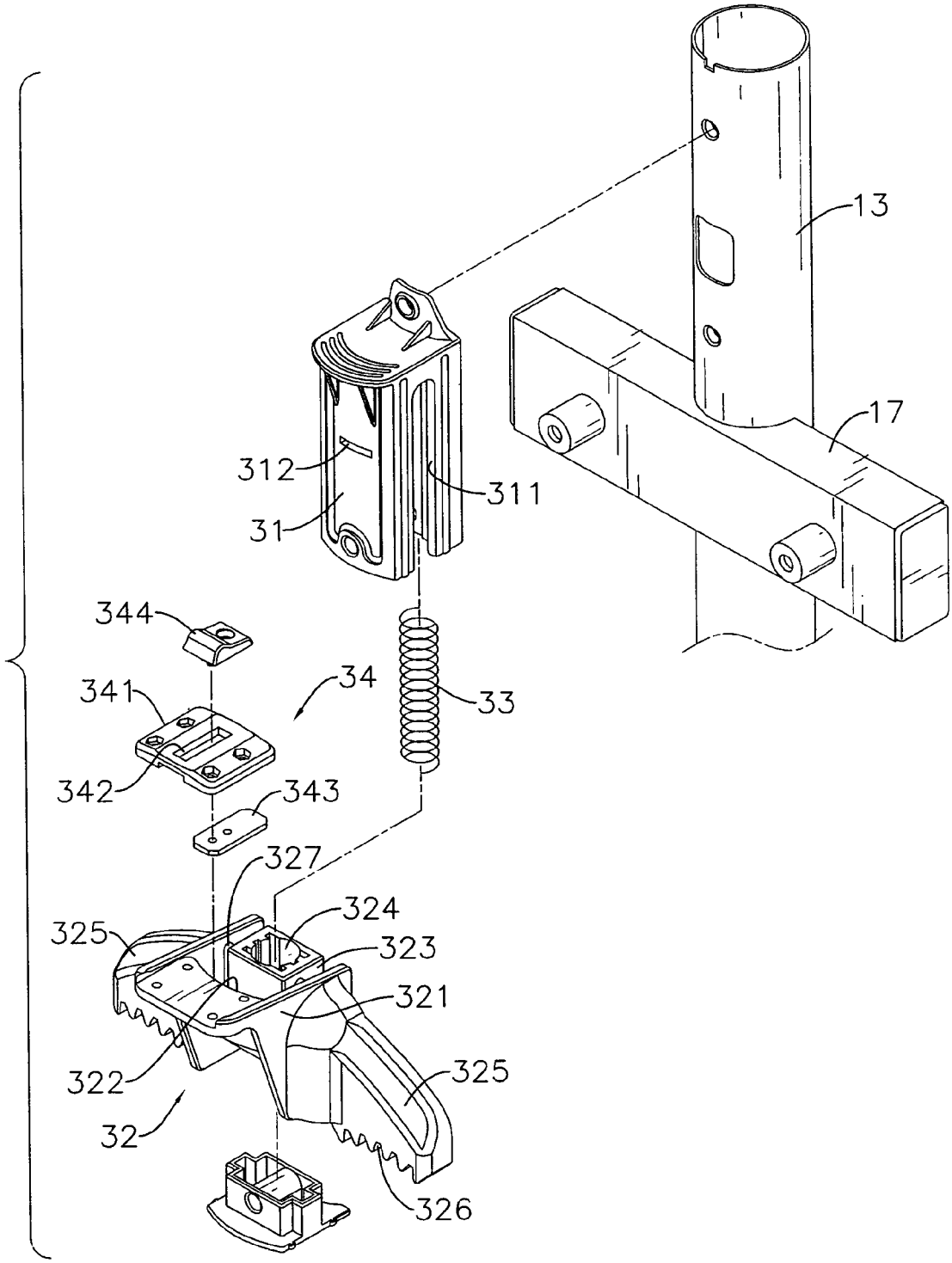
FIG. 6 is an enlarged, exploded, perspective view of a lock assembly of the multi-purpose exerciser in FIG. 1.
Figure 7:
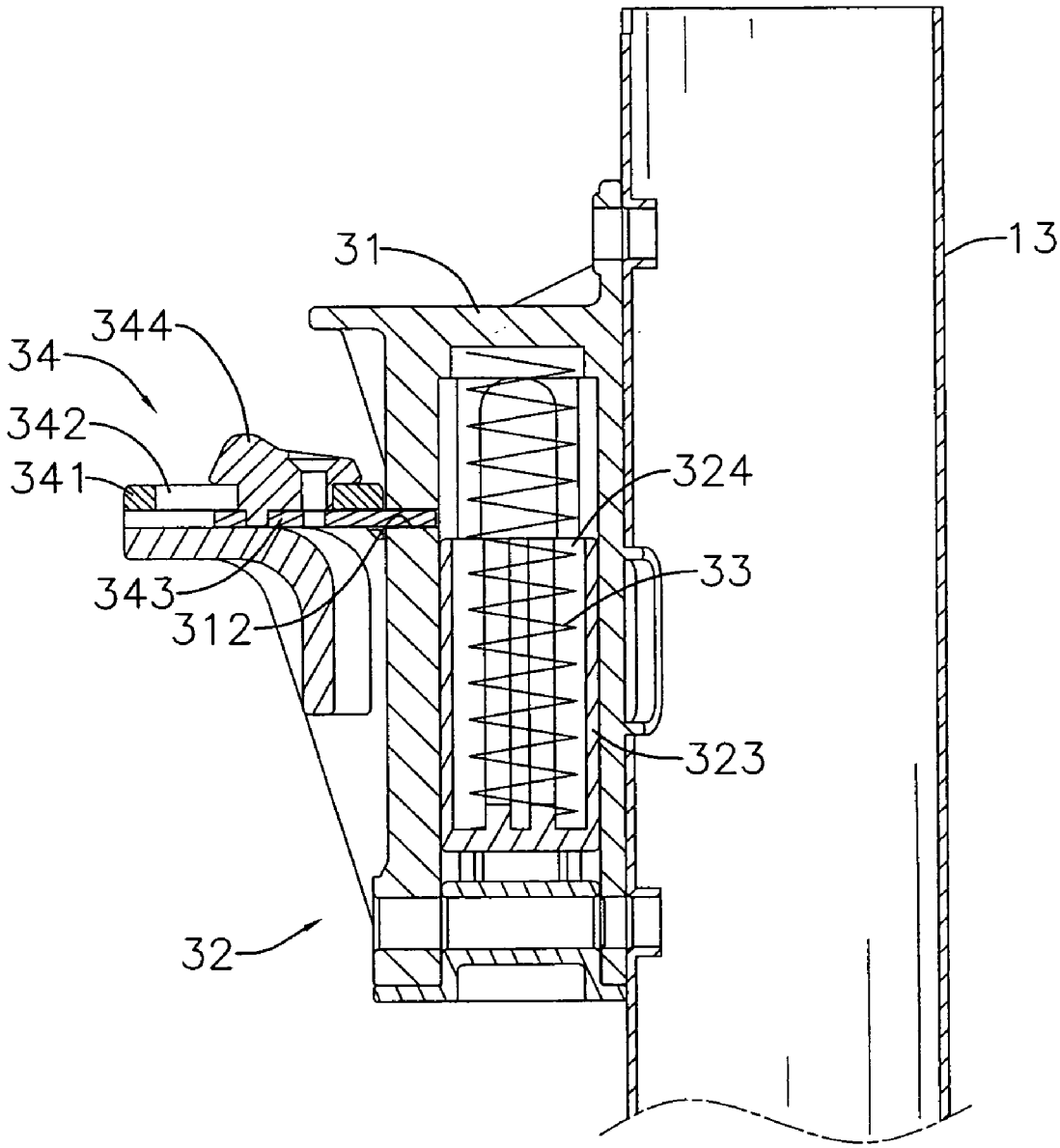
FIG. 7 is a side view in partial section of the lock assembly of the multi-purpose exerciser in FIG. 1.

With further reference to FIGS. 6 and 7, the lock assembly (30) is mounted on the main frame (10) over the gears (21) of the extending assemblies (20), may be mounted on the main support (13) of the main frame (10) over the gears (21) of the extending assemblies (20), has an outer guider (31) and a retainer (32) and may have a spring (33) and a locking set (34).

The outer guider (31) is mounted securely on the main frame (10), may be mounted securely on the main support (13) of the main frame (10), is hollow, has a lower open end, two opposite sidewalls, an outer wall and may have two guiding channels (311) and a locking slot (312). The outer wall of the outer guider (31) is connected between the sidewalls of the outer guider (31). The guiding channels (311) are formed respectively through the sidewalls of the outer guider (31). The locking slot (312) is formed through the outer wall of the outer guider (31).

The retainer (32) is mounted under the outer guider (31) and has a locking bracket (321) and two locking wings (325).

The locking bracket (321) is slidably mounted around the outer guider (31), has an upper end, a lower end and two opposite sides and may have a sliding channel (322), an inner guider (323) and two connectors (327). The sliding channel (322) is formed through the upper end of the locking bracket (321) to the lower end of the locking bracket (321). The inner guider (323) is mounted securely in the sliding channel (322) and is mounted slidably in the outer guider (31) and has an upper end and a mounting recess (324). The mounting recess (324) is formed in the upper end of the inner guider (323). The connectors (327) are formed on the inner guider (323) and are mounted respectively and slidably in the guiding channels (311) of the outer guider (31).

Figure 8:
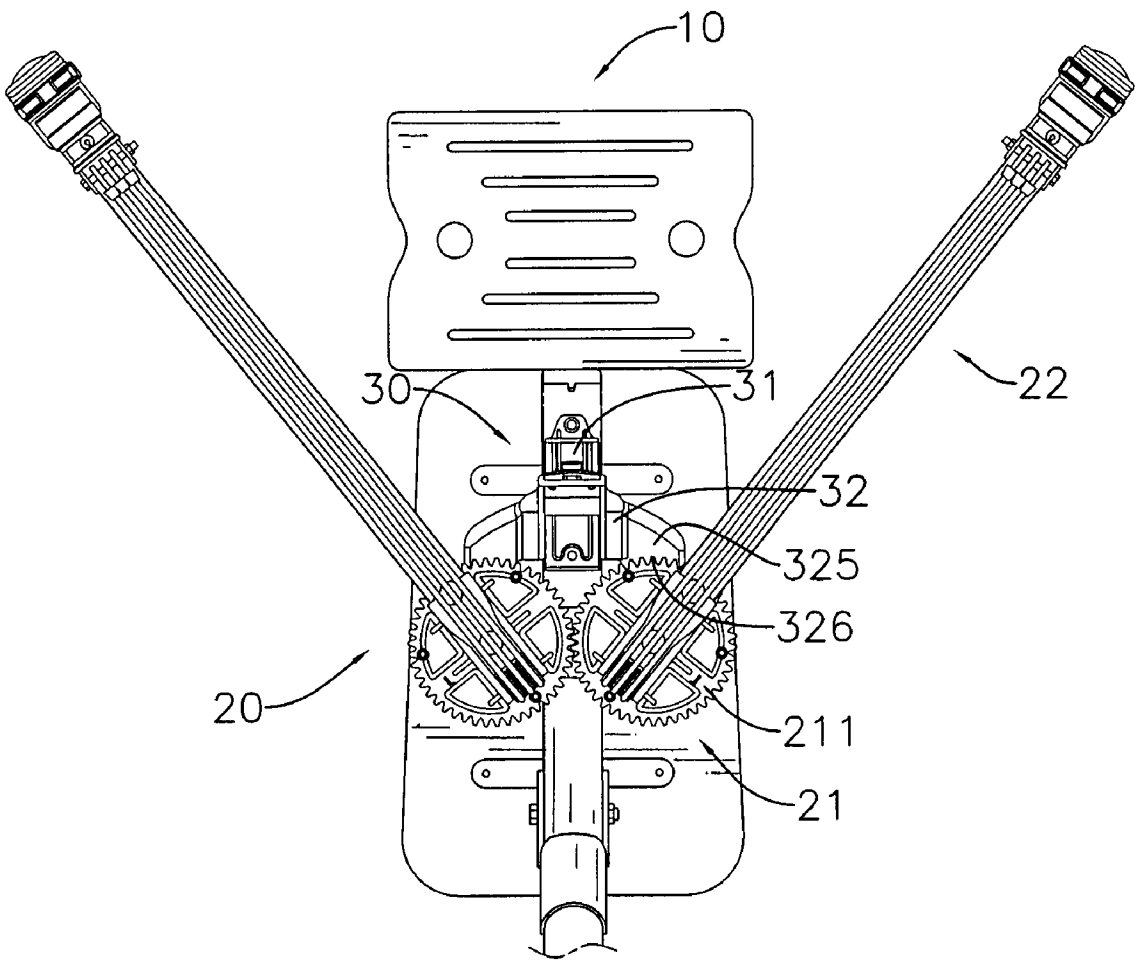
FIG. 8 is an enlarged, operational rear view of the multi-purpose exerciser in FIG. 1, showing elongated brackets up.

With further reference to FIG. 8, the locking wings (325) respectively protrude from the sides of the locking bracket (321) and respectively correspond to the gears (21). Each locking wing (325) has a lower edge and multiple teeth (326). The teeth (326) are formed on the lower edge of the locking wing (325) and selectively engage a corresponding gear (21) to hold the extending assemblies (20) at specific angles.

The spring (33) is mounted between the outer guider (31) and the retainer (32), may be mounted in the mounting recess (324) of the inner guider (323) of the locking bracket (321) and has two ends. The ends of the spring (33) respectively abut the outer guider (31) and the retainer (32) and push the retainer (32).

The locking set (34) is mounted on the locking bracket (321) of the retainer (32), selectively locks the retainer (32) to the outer guider (31) and may have a cover (341), a latch (343) and a button (344). The cover (341) is mounted on the upper end of the locking bracket (321) of the retainer (32) and has a guiding slot (342). The guiding slot (342) is formed through the cover (341). The latch (343) is mounted slidably between the locking bracket (321) and the cover (341) and is selectively mounted in the locking slot (312) of the outer guider (31) to hold the retainer (32) securely on the outer guider (31), while the teeth (326) of the locking wings (325) of the retainer (32) engage the gears (21). Consequently, the elongated brackets (22) are held at specific angles. The button (344) is mounted on the outer surface of the cover (341) and is connected to the latch (343) through the guiding slot (342) of the cover (341) to allow the latch (343) to slide together with the button (344) along the guiding slot (342) of the cover(341).

Figure 9:
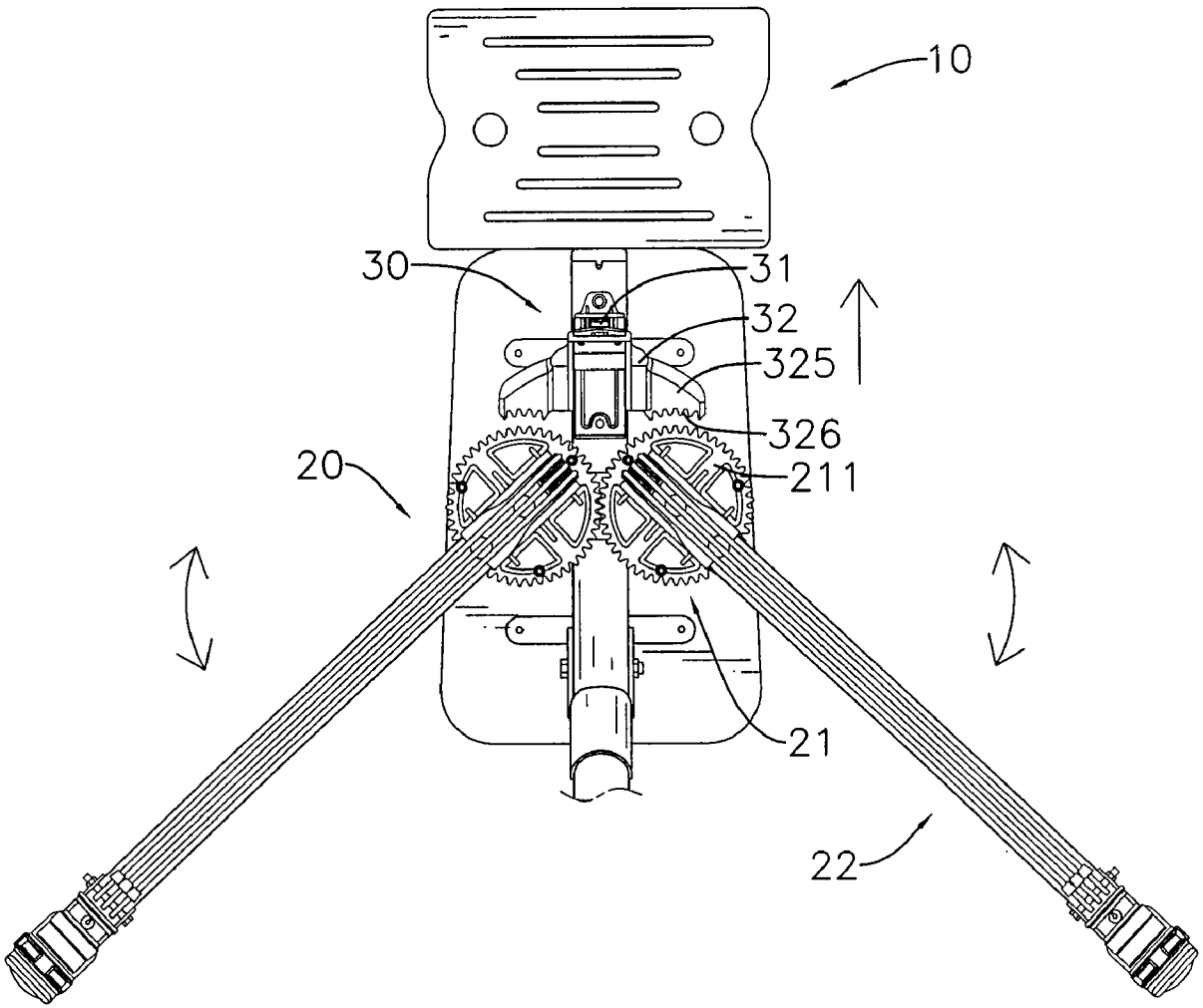
FIG. 9 is an enlarged, operational rear view of the multi-purpose exerciser in FIG. 1, showing elongated brackets down.

With further reference to FIG. 9, when the latch (343) of the locking set (34) disengages from the locking slot (312) of the outer guider (31), the retainer (32) is able to slide upwards. Thus, the spring (33) being mounted between the outer guider (31) and the retainer (32) is pressed and the teeth (326) of the locking wings (325) of the retainer (32) disengage the gears (21) of the extending assemblies (20). Since the gears (21) of the extending assemblies (20) engage each other, once one of the extending assemblies (20) pivots, the other extending assemblies (20) synchronously pivots. After, the retainer (32) loosens and the spring (33) pushes the retainer (32) to allow the teeth (326) of the locking wings (325) of the retainer (32) to engage the gears (21) of the extending assemblies (20) again. The gears (21) and the extending tubes (22) of the extending assemblies (20) are held at a specific angle.

The multi-purpose exerciser as described has the following advantages. The exerciser pulls the rope sets (25) of the extending assemblies (20) to resist elastic force of the at least one rope (251) of the rope sets (25) and therefore the exerciser is trained. Furthermore, according to the angles at which the extending assemblies (20) are held, the exerciser pulls the rope sets (25) in different ways. Thus, different parts of the exerciser's body are trained.

Figure 10:
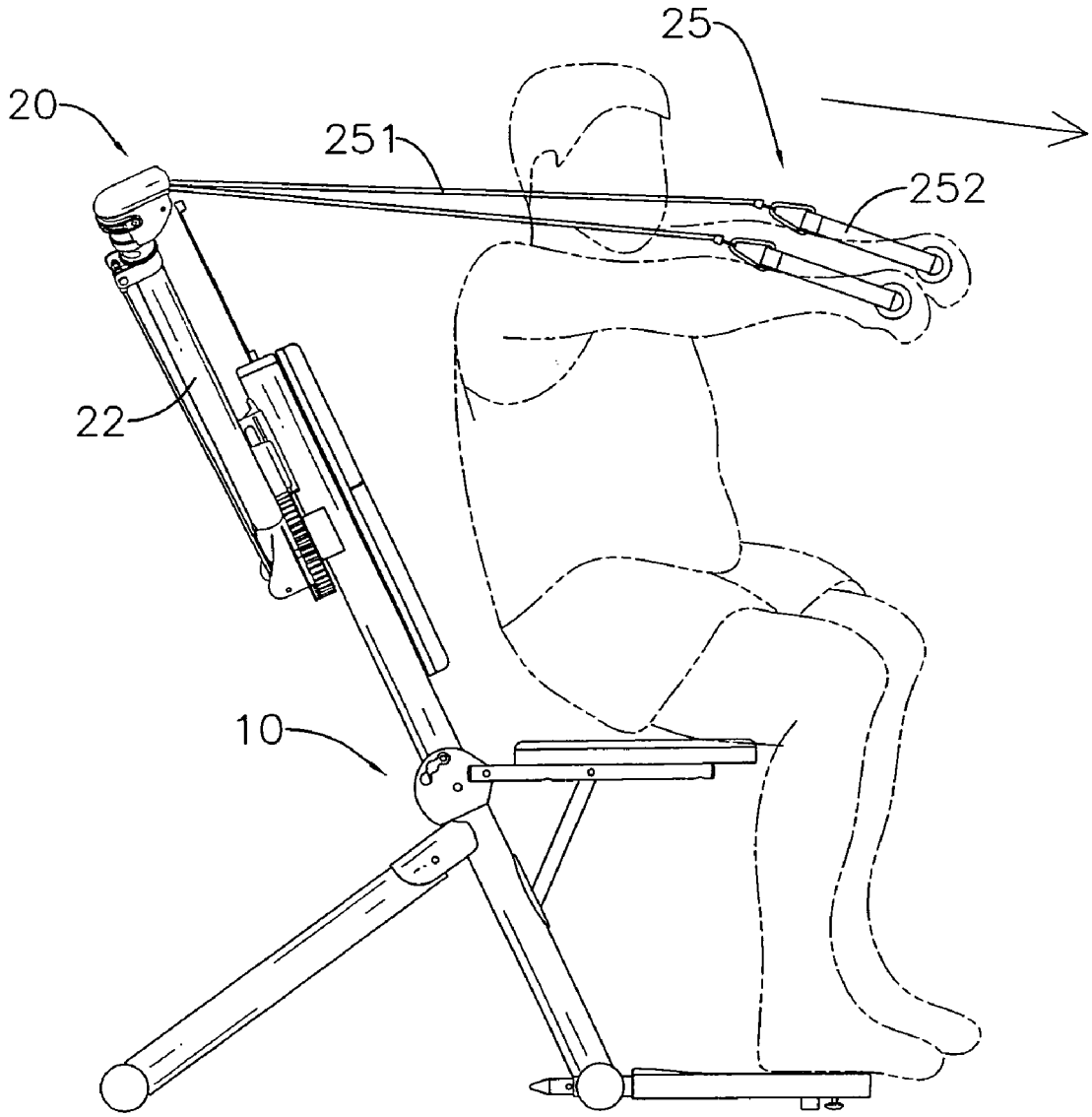
FIGS. 10 to 15 are operational side views of the multi-purpose exerciser in FIG. 1, demonstrating different operational modes of the multi-purpose exerciser.

With reference to FIG. 10, to train arm and back muscles the extending tubes (22) of the extending assemblies (20) are extended upwardly by raising arms and holding and pulling the rope sets (25) of the extending assemblies (20) forward.

Figure 11:
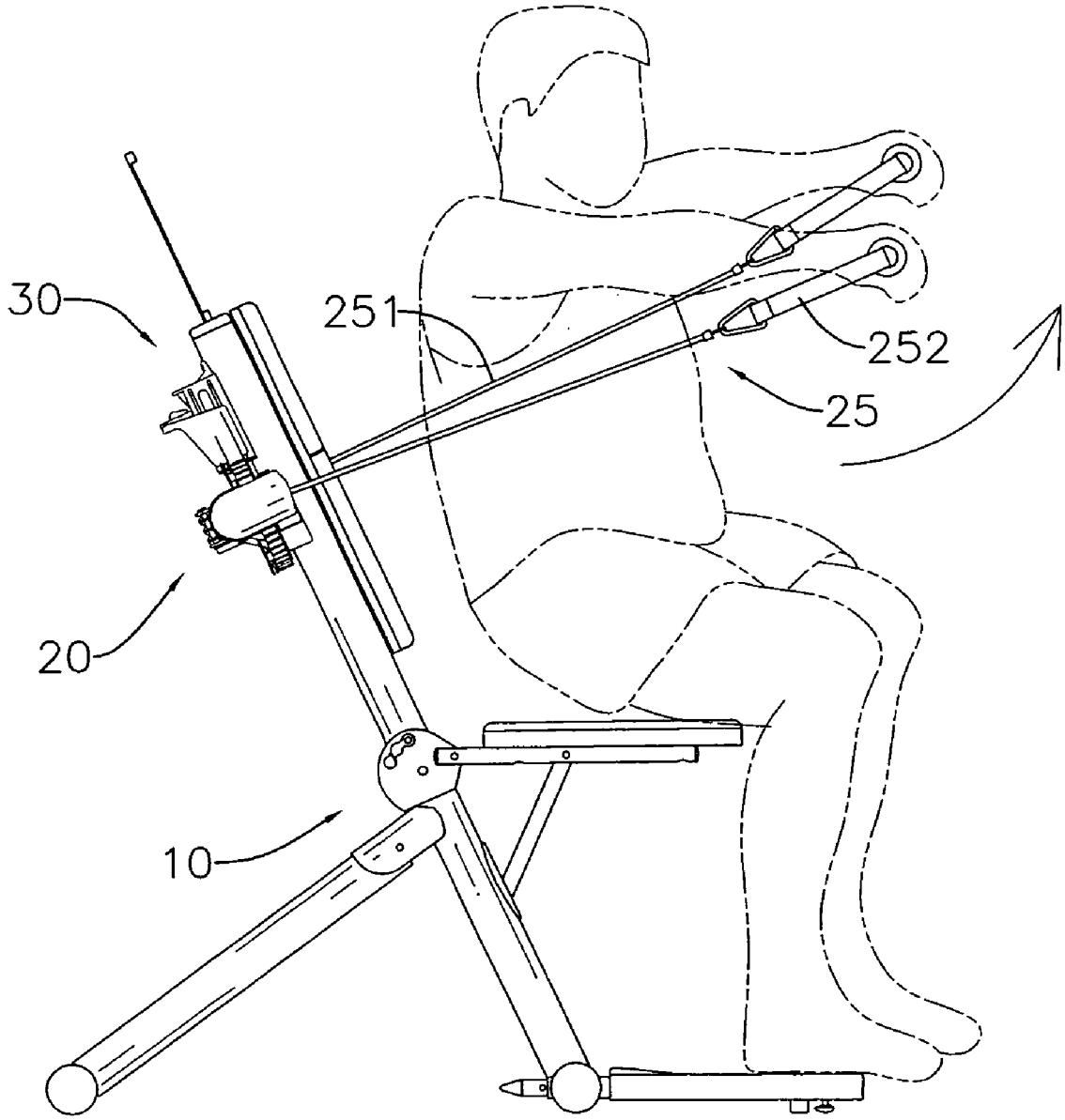

With reference to FIG. 11, to train arms, back muscles and chest the extending tubes (22) of the extending assemblies (20) are extended horizontally by raising arms laterally and holding and pulling the rope sets (25) of the extending assemblies (20) forward.

Figure 12:
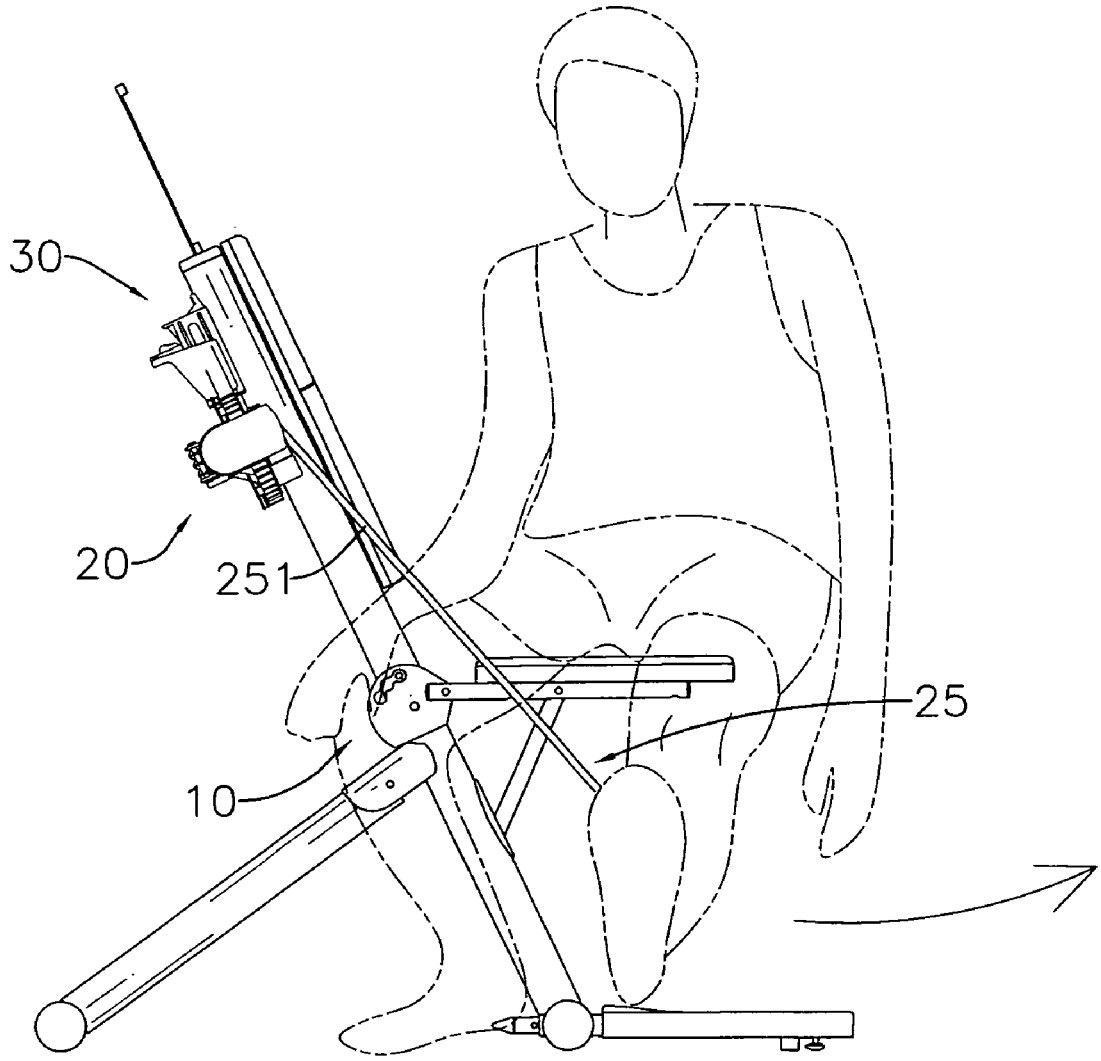

With further reference to FIG. 12, to train quadriceps the exerciser may turn aside, hook one leg in the handle (252) of one of the rope sets (25) and then move the leg sideways.

Figure 13:
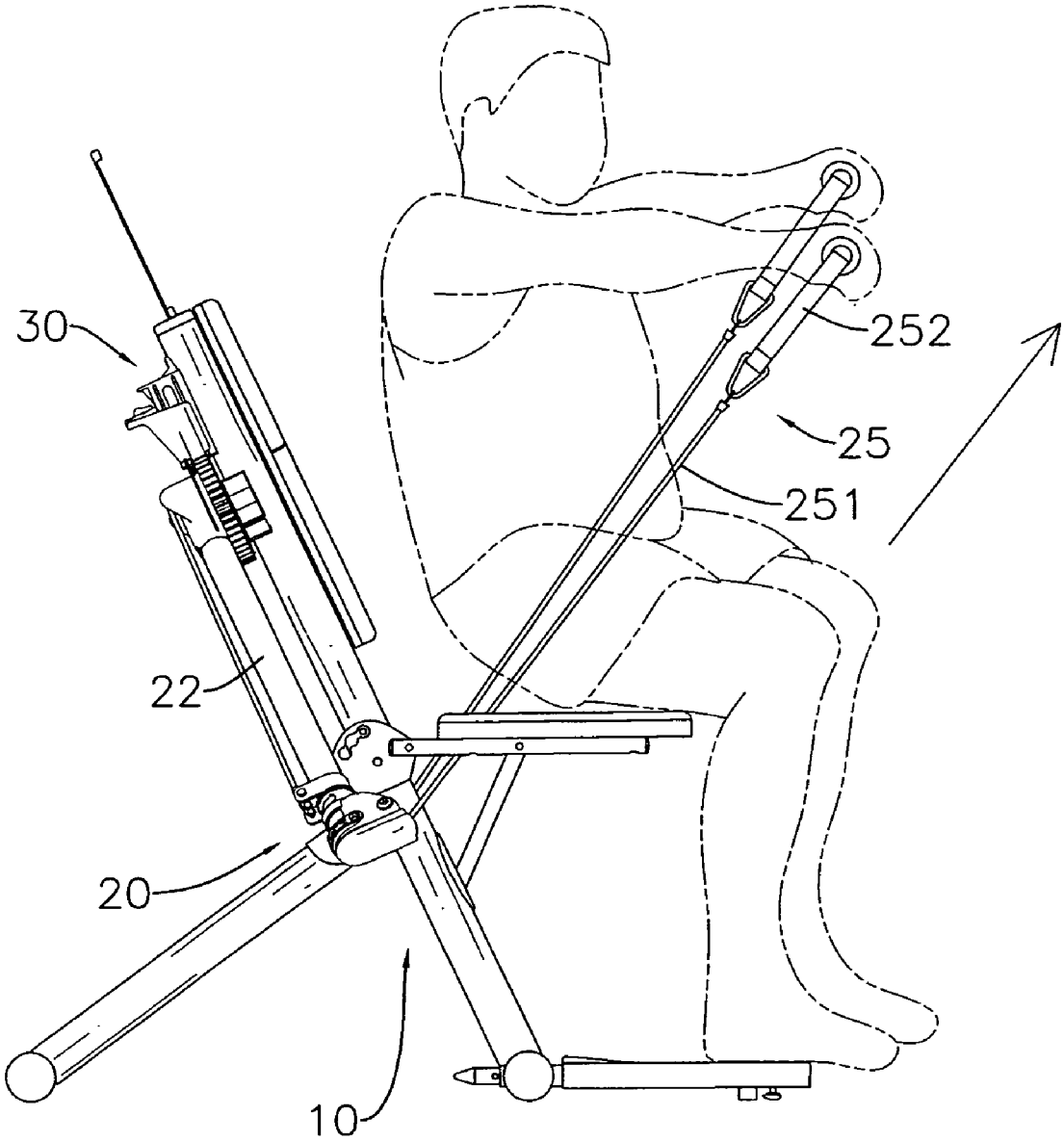

With reference to FIG. 13, to train arms the extending tubes (22) of the extending assemblies (20) are extended downwardly by holding and pulling the rope sets (25) of the extending assemblies (20) upward.

Figure 14:
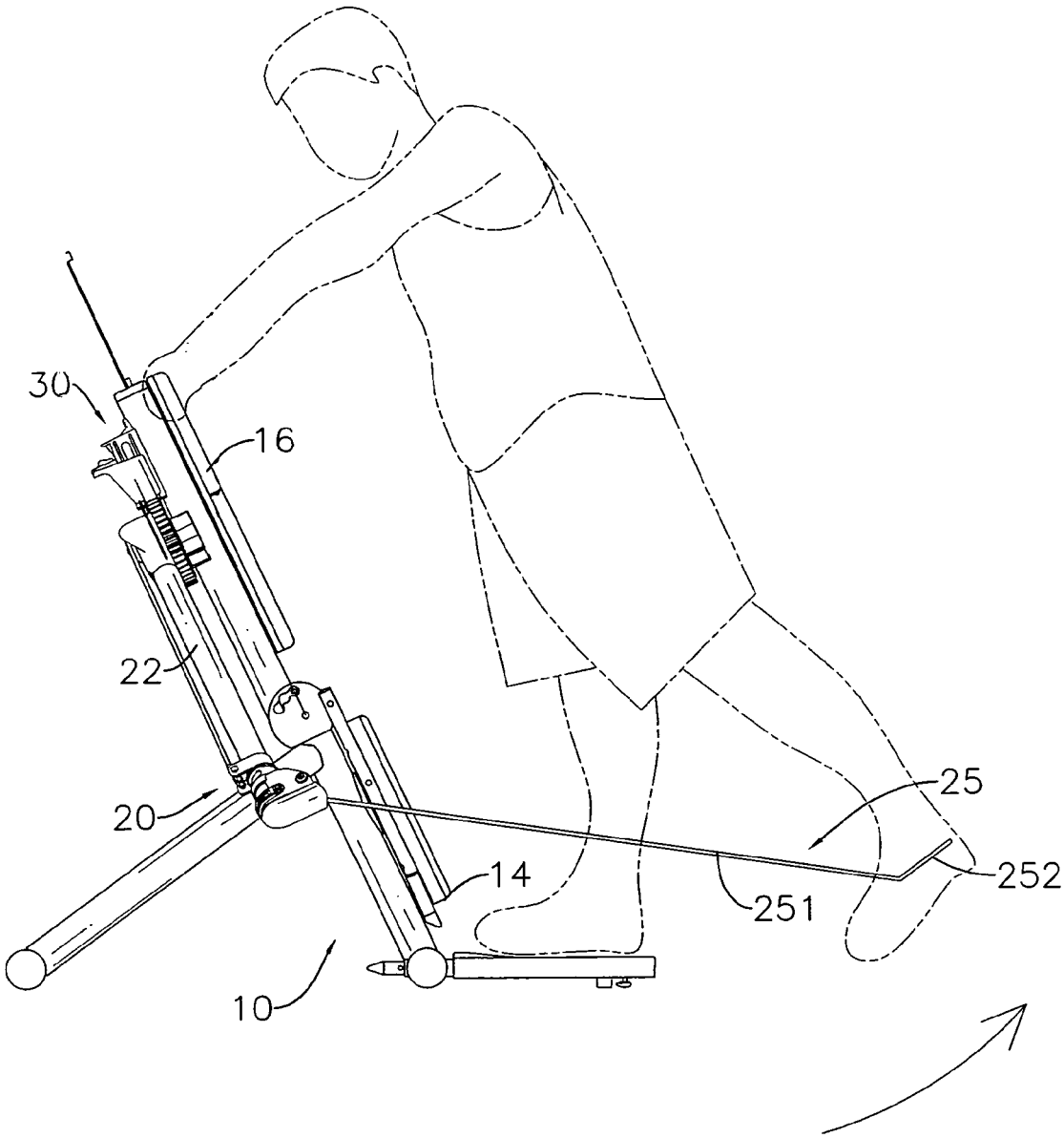

With further reference to FIG. 14, to train buttocks and thighs the seat cushion (14) of the main frame (10) is folded, hands placed on the back cushion (16) of the main frame (10), one leg is hooked in the handle (252) of one of the rope sets (25) and extended backward.

Figure 15:
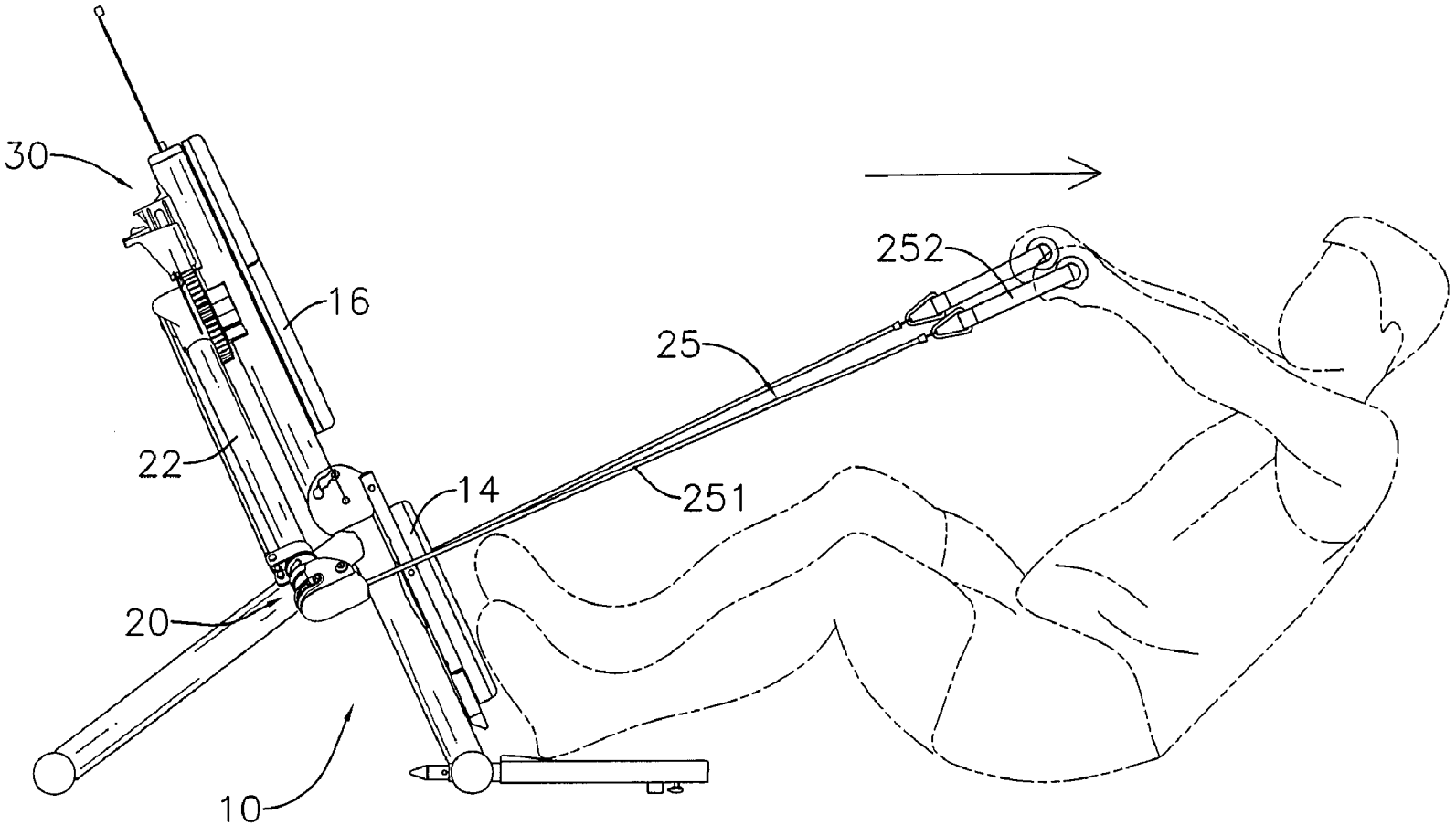

With further reference to FIG. 15, to train abdominal muscles the exerciser lies down on the ground with his legs abutting the base (11) of the main frame (10) and pulls the handles (252) of the rope sets (25) to perform sit-ups.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multi-purpose exerciser comprising a main frame;

two extending assemblies being mounted pivotally on the main frame, and each extending assembly having a gear being mounted pivotally on the main frame, wherein the gears of the extending assemblies engage each other;

a mounting panel being attached securely to the gear;

an elongated bracket being connected to the mounting panel and having an extending tube being mounted radially and securely on the mounting panel and having a proximal open end; and a distal open end; and a rope set being connected to the elongated bracket and having at least one rope being extensible and being mounted longitudinally through the extending tube of the elongated bracket, and each of the at least one rope having a fastening end corresponding to the proximal open end of the extending tube of the elongated bracket and being attached to the extending tube of the elongated bracket; and an extending end corresponding to and extending out from the distal open end of the extending tube of the elongated bracket; and a handle being connected to the extending end of each of the at least one rope; and a lock assembly being mounted on the main frame over the gears of the extending assemblies and having an outer guider being mounted securely on the main frame and being tubular; and a retainer being mounted under the outer guider and having a locking bracket being slidably mounted around the outer guider and having two opposite sides; and two locking wings respectively protruding from the sides of the locking bracket and respectively corresponding to the gears, and each locking wing having a lower edge; and multiple teeth being formed on the lower edge of the locking wing and selectively engaging a corresponding gear.

2. The multi-purpose exerciser as claimed in claim 1, wherein the lock assembly further has a spring being mounted between the outer guider and the retainer; and a locking set being mounted on the locking bracket of the retainer and selectively locking the retainer to the outer guider.

3. The multi-purpose exerciser as claimed in claim 2, wherein the outer guider of the lock assembly further has a lower open end;

two opposite sidewalls; and two guiding channels being formed respectively through the sidewalls of the outer guider;

the retainer of the lock assembly further has an upper end;

a lower end;

a sliding channel being formed through the upper end of the locking bracket to the lower end of the locking bracket;

an inner guider being mounted securely in the sliding channel and being mounted slidably in the outer guider and having an upper end; and a mounting recess being formed in the upper end of the inner guider; and two connectors being formed on the inner guider and being mounted respectively and slidably in the guiding channels of the outer guider; and the spring of the lock assembly is mounted in the mounting recess of the inner guider of the locking bracket and has two ends respectively abutting the outer guider and the retainer and pushing the retainer.

4. The multi-purpose exerciser as claimed in claim 3, wherein the outer guider of the lock assembly further has an outer wall being connected between the sidewalls of the outer guider; and a locking slot being formed through the outer wall of the outer guider; and the locking set of the lock assembly further has a cover being mounted on the upper end of the locking bracket of the retainer and having a guiding slot being formed through the cover;

a latch being mounted slidably between the locking bracket and the cover and being selectively mounted in the locking slot of the outer guider; and a button being mounted on the outer surface of the cover and being connected to the latch through the guiding slot of the cover.

5. The multi-purpose exerciser as claimed in claim 1, wherein the gear of each extending assembly further has a mounting tube being attached radially on the mounting panel;

the elongated bracket of each extending assembly further has a roller mount being mounted on the distal open end of the extending tube and communicating with the extending tube;

the proximal open end of the extending tube of the elongated bracket of each extending assembly is mounted securely in the mounting tube of the gear;

each extending assembly further has a lower roller set being mounted rotatably in the mounting tube of the gear and having at least one roller; and an upper roller set being mounted rotatably in the roller mount and having at least one roller; and the at least one rope of the rope set is mounted across the roller sets.

6. The multi-purpose exerciser as claimed in claim 2, wherein the gear of each extending assembly further has a mounting tube being attached radially on the mounting panel;

the elongated bracket of each extending assembly further has a roller mount being mounted on the distal open end of the extending tube and communicating with the extending tube;

the proximal open end of the extending tube of the elongated bracket of each extending assembly is mounted securely in the mounting tube of the gear;

each extending assembly further has a lower roller set being mounted rotatably in the mounting tube of the gear and having at least one roller; and an upper roller set being mounted rotatably in the roller mount and having at least one roller; and the at least one rope of the rope set is mounted across the roller sets.

7. The multi-purpose exerciser as claimed in claim 3, wherein the gear of each extending assembly further has a mounting tube being attached radially on the mounting panel;

the elongated bracket of each extending assembly further has a roller mount being mounted on the distal open end of the extending tube and communicating with the extending tube;

the proximal open end of the extending tube of the elongated bracket of each extending assembly is mounted securely in the mounting tube of the gear;

each extending assembly further has a lower roller set being mounted rotatably in the mounting tube of the gear and having at least one roller; and an upper roller set being mounted rotatably in the roller mount and having at least one roller; and the at least one rope of the rope set is mounted across the roller sets.

8. The multi-purpose exerciser as claimed in claim 4, wherein the gear of each extending assembly further has a mounting tube being attached radially on the mounting panel;

the elongated bracket of each extending assembly further has a roller mount being mounted on the distal open end of the extending tube and communicating with the extending tube;

the proximal open end of the extending tube of the elongated bracket of each extending assembly is mounted securely in the mounting tube of the gear;

each extending assembly further has a lower roller set being mounted rotatably in the mounting tube of the gear and having at least one roller; and an upper roller set being mounted rotatably in the roller mount and having at least one roller; and the at least one rope of the rope set is mounted across the roller sets.

9. The multi-purpose exerciser as claimed in claim 5, wherein the mounting tube of the gear of each extending assembly further has an outer surface;

the gear of each extending assembly further has two lower wings protruding tangentially from the outer surface of the mounting tube and corresponding to each other; and the lower roller set of each extending assembly is mounted between the lower wings of the gear.

10. The multi-purpose exerciser as claimed in claim 6, wherein the mounting tube of the gear of each extending assembly further has an outer surface;

the gear of each extending assembly further has two lower wings protruding tangentially from the outer surface of the mounting tube and corresponding to each other; and the lower roller set of each extending assembly is mounted between the lower wings of the gear.

11. The multi-purpose exerciser as claimed in claim 7, wherein the mounting tube of the gear of each extending assembly further has an outer surface;

the gear of each extending assembly further has two lower wings protruding tangentially from the outer surface of the mounting tube and corresponding to each other; and the lower roller set of each extending assembly is mounted between the lower wings of the gear.

12. The multi-purpose exerciser as claimed in claim 8, wherein the mounting tube of the gear of each extending assembly further has an outer surface;

the gear of each extending assembly further has two lower wings protruding tangentially from the outer surface of the mounting tube and corresponding to each other; and the lower roller set of each extending assembly is mounted between the lower wings of the gear.

13. The multi-purpose exerciser as claimed in claim 9, wherein the extending tube of the elongated bracket of each extending assembly further has an outer surface; and two upper wings protruding tangentially from the outer surface of the extending tube and corresponding to each other;

the at least one rope of the rope set of each extending assembly further has two connecting leaves being attached respectively and securely to the fastening end and the extending end of the at least one rope;

the rope set of each extending assembly further has a connecting ring being connected to the connecting leaf in the extending end of the at least one rope;

a bolt being mounted through the upper wings of the elongated bracket and the connecting leaf of the at least one rope and having an end; and a fastener being fastened to the end of the bolt; and the handle of the rope set of each extending assembly is connected to the connecting ring.

14. The multi-purpose exerciser as claimed in claim 10, wherein the extending tube of the elongated bracket of each extending assembly further has an outer surface; and two upper wings protruding tangentially from the outer surface of the extending tube and corresponding to each other;

the at least one rope of the rope set of each extending assembly further has two connecting leaves being attached respectively and securely to the fastening end and the extending end of the at least one rope;

the rope set of each extending assembly further has a connecting ring being connected to the connecting leaf in the extending end of the at least one rope;

a bolt being mounted through the upper wings of the elongated bracket and the connecting leaf of the at least one rope and having an end; and a fastener being fastened to the end of the bolt; and the handle of the rope set of each extending assembly is connected to the connecting ring.

15. The multi-purpose exerciser as claimed in claim 11, wherein the extending tube of the elongated bracket of each extending assembly further has an outer surface; and two upper wings protruding tangentially from the outer surface of the extending tube and corresponding to each other;

the at least one rope of the rope set of each extending assembly further has two connecting leaves being attached respectively and securely to the fastening end and the extending end of the at least one rope;

the rope set of each extending assembly further has a connecting ring being connected to the connecting leaf in the extending end of the at least one rope;

a bolt being mounted through the upper wings of the elongated bracket and the connecting leaf of the at least one rope and having an end; and a fastener being fastened to the end of the bolt; and the handle of the rope set of each extending assembly is connected to the connecting ring.

16. The multi-purpose exerciser as claimed in claim 12, wherein the extending tube of the elongated bracket of each extending assembly further has an outer surface; and two upper wings protruding tangentially from the outer surface of the extending tube and corresponding to each other;

the at least one rope of the rope set of each extending assembly further has two connecting leaves being attached respectively and securely to the fastening end and the extending end of the at least one rope;

the rope set of each extending assembly further has a connecting ring being connected to the connecting leaf in the extending end of the at least one rope;

a bolt being mounted through the upper wings of the elongated bracket and the connecting leaf of the at least one rope and having an end; and a fastener being fastened to the end of the bolt; and the handle of the rope set of each extending assembly is connected to the connecting ring.

17. The multi-purpose exerciser as claimed in claim 1, wherein the main frame further has a base having an upper end; and a lower end;

a side support being connected to and supporting the base;

a main support being mounted on the upper end of the base and protruding upwardly; and a gear mount being mounted securely on the main support;

the extending assemblies are mounted pivotally on the gear mount of the main frame;

the mounting panel of the gear of each extending assembly is mounted rotatably on the gear mount of the main frame;

the lock assembly is mounted on the main support of the main frame over the gears of the extending assemblies; and the outer guider of the lock assembly is mounted securely on the main support of the main frame.

18. The multi-purpose exerciser as claimed in claim 17, wherein the main frame further has a seat cushion being connected pivotally to the base adjacent to the upper end of the base;

a footrest being mounted on the base adjacent to the lower end of the base and corresponding to the seat cushion; and a back cushion being mounted on the main support opposite to the gear mount of the main frame.

19. The multi-purpose exerciser as claimed in claim 17, wherein the main frame further has an adjusting bracket being mounted on the upper end of the base and having two opposite sidewalls; and multiple mounting holes being separately formed through the sidewalls of the adjusting bracket, and two corresponding mounting holes being respectively formed on the opposite sidewalls of the adjusting bracket and are aligned with each other;

the main support of the main frame is mounted on the adjusting bracket; and the main frame further has a rod being mounted through the corresponding mounting holes of the adjusting bracket and the main support.

* * * * *